US011318526B2

(12) United States Patent
Kim et al.

(10) Patent No.: US 11,318,526 B2
(45) Date of Patent: May 3, 2022

(54) ALUMINUM ALLOY FOR DIE CASTING AND DIE CASTING MOLD MANUFACTURED USING THE SAME

(71) Applicant: LG ELECTRONICS INC., Seoul (KR)

(72) Inventors: Myeongdeok Kim, Seoul (KR); Seongmo Bae, Seoul (KR)

(73) Assignee: LG Electronics Inc., Seoul (KR)

( * ) Notice: Subject to any disclaimer, the term of this patent is extended or adjusted under 35 U.S.C. 154(b) by 147 days.

(21) Appl. No.: 15/843,370

(22) Filed: Dec. 15, 2017

(65) Prior Publication Data

US 2018/0169745 A1 Jun. 21, 2018

(30) Foreign Application Priority Data

Dec. 16, 2016 (KR) ..... 10-2016-0173047

(51) Int. Cl.

| | |
|---|---|
| ***C22C 21/02*** | (2006.01) |
| ***C22C 21/04*** | (2006.01) |
| ***B22C 9/06*** | (2006.01) |
| ***B22D 17/22*** | (2006.01) |
| *D06F 37/02* | (2006.01) |

(52) U.S. Cl.

CPC ..... *B22C 9/061* (2013.01); *B22D 17/2209* (2013.01); *C22C 21/02* (2013.01); *C22C 21/04* (2013.01); *D06F 37/02* (2013.01)

(58) Field of Classification Search

CPC ..... D06F 37/02; C22C 21/02

See application file for complete search history.

(56) References Cited

U.S. PATENT DOCUMENTS

| | | | | |
|---|---|---|---|---|
| 7,347,905 | B1 | 3/2008 | Donahue et al. | |
| 8,097,101 | B2 * | 1/2012 | Dahle | C22B 21/06 148/437 |
| 2002/0060059 | A1 * | 5/2002 | Komazaki | B22D 17/00 164/113 |
| 2005/0067383 | A1 | 3/2005 | Ohashi et al. | |

(Continued)

FOREIGN PATENT DOCUMENTS

| | | |
|---|---|---|
| CN | 1290761 | 4/2001 |
| CN | 102575323 | 7/2012 |

(Continued)

OTHER PUBLICATIONS

Davis, J. R. "Aluminum and Aluminum Alloys", ASM International, p. 93, 223-224. (Year: 1993).*

(Continued)

*Primary Examiner* — George Wyszomierski
*Assistant Examiner* — Janell C Morillo
(74) *Attorney, Agent, or Firm* — Fish & Richardson P.C.

(57) ABSTRACT

The present disclosure relates to an aluminum alloy for die casting, more particularly, to an aluminum alloy for die casting which has high corrosion resistance, strength and castability.

The embodiments of the present disclosure provide an aluminum alloy for die casting comprising a composition ratio having an aluminum (Al) content which occupies almost the composition ratio of the aluminum alloy; a magnesium (Mg) content of 2.5~3.0%; a silicon (Si) content of 9.6~0.5%; a zinc (Zn) content of 0.5% or less; and a copper (Cu) content of 0.15% or less.

8 Claims, 4 Drawing Sheets

(56) References Cited

U.S. PATENT DOCUMENTS

| | | | | |
|---|---|---|---|---|
| 2006/0179897 | A1 | 8/2006 | Saito | |
| 2012/0148444 | A1* | 6/2012 | Nagaishi | C22C 21/02 420/534 |
| 2016/0060731 | A1* | 3/2016 | Hwang | C22C 21/02 420/541 |
| 2017/0260678 | A1* | 9/2017 | Wee | D06F 37/266 |

FOREIGN PATENT DOCUMENTS

| | | | | |
|---|---|---|---|---|
| CN | 105385903 | | 3/2016 | |
| CN | 107312955 | | 11/2017 | |
| EP | 1083238 | A2 | 3/2001 | |
| EP | 1657346 | A1 * | 5/2006 | D06F 37/04 |
| EP | 2803438 | A2 | 11/2014 | |
| EP | 2992983 | A2 | 3/2016 | |
| JP | S51046549 | | 4/1976 | |
| JP | 1994212334 | | 8/1994 | |
| JP | 2002003972 | | 1/2002 | |
| JP | 2009024265 | | 2/2009 | |
| KR | 1020040088857 | | 10/2004 | |
| KR | 100521522 | | 10/2005 | |
| KR | 1020120108727 | | 4/2014 | |
| KR | 1020160027853 | | 3/2016 | |
| KR | 1020160027853 | | 7/2016 | |
| KR | 1020160138866 | | 12/2016 | |
| KR | 101756016 | | 7/2017 | |
| KR | 1020180035390 | | 4/2018 | |

OTHER PUBLICATIONS

International Search Report and Written Opinion in International Application No. PCT/KR2017/014811, dated May 11, 2018, 10 pages.

Extended European Search Report in European Application No. 17207810.7, dated Mar. 14, 2018, 9 pages.

Korean Notice of Allowance in Korean Application No. 10-2019-0020769, dated May 11, 2019, 1 page.

Chinese Office Action in Chinese Application No. 201780077456.X, dated Aug. 3, 2020, 28 pages (with English translation).

Heo et al., "Microstructure and mechanical property of aluminium based die-cast alloy (ALDC6) for spider arm component," InIOP Conference Series: Materials Science and Engineering, 2020, 715(1):012101, 6 pages.

* cited by examiner (a) (b) (c)

FIG. 3

| Classification | Cu | Mg corrosion resistance | Si castability | Zn | Fe | Mn | Ni | Sn | Pb | Ti | Ca | B | Be | Moldability | Breaking strength |
|---|---|---|---|---|---|---|---|---|---|---|---|---|---|---|---|
| ALDC3 | 0.6 ↓ | 0.45 ~ 0.65 | 9.0 ~ 11.0 | 0.5 ↓ | 0.6 ~ 1.0 | 0.3 ↓ | 0.5 ↓ | 0.1 ↓ | 0.15 ↓ | 0.3 ↓ | - | - | - | O | 3,821kgf |
| ALDC6 | 0.1 ↓ | 2.6 ~ 4.0 | 1.0 ↓ | 0.4 ↓ | 0.6 ↓ | 0.4 ~ 0.6 | 0.1 ↓ | 0.1 ↓ | 0.1 ↓ | 0.2 ↓ | - | - | - | X | 3,762kgf |
| ALDC6 - Si10 | 0.15 ↓ | 2.6 ~ 3.0 | 9.9 ~ 10.5 | 0.5 ↓ | 0.6 ~ 0.7 | 0.5 ~ 0.6 | 0.03 ↓ | 0.03 ↓ | 0.05 ↓ | 0.01 ~ 0.02 | 0.01 ↓ | 0.002 ~ 0.004 | 0.005 ~ 0.008 | O | 3,818kgf |

FIG. 4

| Classification | Cu | Si | Mg | Zn | Fe | Mn | Ni | Sn | Pb | Ti | B | Be | Sr | Ca | Castability | Corrosion resistance | Breaking strength |
|---|---|---|---|---|---|---|---|---|---|---|---|---|---|---|---|---|---|
| SBN 2nd | 0.1 ↓ | 1.8 ~ 2.3 | 2.0 ~ 2.5 | 2.0 ~ 2.5 | 0.6 ~ 0.7 | 1.0 ~ 1.3 | 0.03 ↓ | 0.03 ↓ | 0.05 ↓ | 0.008 ~ 0.012 | 0.002 ~ 0.004 | 0.003 ~ 0.005 | - | 0.03 ↓ | X | O | - |
| SBN 3rd | 0.1 ↓ | 5.6 ~ 6.0 | 2.5 ~ 3.0 | 2.0 ~ 2.5 | 0.6 ~ 0.7 | 0.5 ~ 0.6 | 0.03 ↓ | 0.03 ↓ | 0.05 ↓ | 0.008 ~ 0.012 | 0.002 ~ 0.004 | 0.003 ~ 0.005 | 0.01 ~ 0.015 | 0.03 ↓ | △ | O | 2,900 |
| SBN 4th | 0.1 ↓ | 5.6 ~ 6.0 | 2.5 ~ 3.0 | 0.5 ~ 1.0 | 0.6 ~ 0.7 | 0.5 ~ 0.6 | 0.03 ↓ | 0.03 ↓ | 0.05 ↓ | 0.008 ~ 0.012 | 0.002 ~ 0.004 | 0.003 ~ 0.005 | 0 | 0.03 ↓ | △ | O | 3,200 |
| SBN 5th | 0.1 ↓ | 9.6 ~ 10.5 | 2.5 ~ 3.0 | 0.5 ↓ | 0.6 ~ 0.7 | 0.5 ~ 0.6 | 0.03 ↓ | 0.03 ↓ | 0.05 ↓ | 0.008 ~ 0.012 | 0.002 ~ 0.004 | 0.003 ~ 0.005 | 0 | 0.03 ↓ | O | O | 3,600 |
| SBN 6th | 0.4 ~ 0.6 | 9.6 ~ 10.5 | 2.5 ~ 3.0 | 0.5 ↓ | 0.6 ~ 0.7 | 0.5 ~ 0.6 | 0.03 ↓ | 0.03 ↓ | 0.05 ↓ | 0.008 ~ 0.012 | 0.002 ~ 0.004 | 0.003 ~ 0.005 | 0 | 0.03 ↓ | O | △ | 3,800 |
| SBN 7th | 0.4 ~ 0.6 | 10.0 ~ 10.5 | 3.0 ~ 3.5 | 0.5 ↓ | 0.6 ~ 0.7 | 0.5 ~ 0.6 | 0.03 ↓ | 0.03 ↓ | 0.05 ↓ | 0.008 ~ 0.012 | 0 | 0.003 ~ 0.005 | 0 | 0.03 ↓ | O | △ | 3,800 |
| SBN 8th | 0.15 ↓ | 9.9 ~ 10.5 | 2.6 ~ 3.0 | 0.5 ↓ | 0.6 ~ 0.7 | 0.5 ~ 0.6 | 0.03 ↓ | 0.03 ↓ | 0.05 ↓ | 0.01 ~ 0.02 | 0.002 ~ 0.004 | 0.005 ~ 0.008 | 0 | 0.01 ↓ | O | O | 3,600 ~4,000 |

ALUMINUM ALLOY FOR DIE CASTING AND DIE CASTING MOLD MANUFACTURED USING THE SAME

Pursuant to 35 U.S.C. § 119(a), this application claims the benefit of earlier filing date and right of priority to Korean Application No. 10-2016-0173047, filed on Dec. 16, 2016, the contents of which are hereby incorporated by reference herein in their entirety.

BACKGROUND OF THE DISCLOSURE

Field of the Disclosure

The present invention relates to an aluminum alloy for die casting, more particularly, to an aluminum alloy for die casting which has high corrosion resistance, strength and castability.

Discussion of the Related Art

Die casting is a fine casting method for fabricating a structure such as a mold by injecting a molten metal into a mold processed precisely to match a needed shape, in other words, a cast shape. The structure or product manufactured by such die casting is called "die casting mold".

The die casting facilitates the precise mold manufacturing to require no following processes such as a surface processing. Accordingly, it can be said that the die casting is proper to mass production.

Generally, an aluminum alloy is used as a material for die casting. The cast fabricated of the aluminum alloy is used in quite diverse fields and diverse kinds of aluminum alloys are used according to purposes, respectively.

KSD 6006 shows a regulatory component of aluminum alloy for die casting. For example, approximately 14 types of alloys are suggested and 14 types of aluminum alloys from ALDC-1 to ALDC-14 are regulated. Similar to Korean Standards, American Standards Association (AA) and Japanese Industrial Standard (JIS) disclose a regulatory component according to types of aluminum alloys.

In general, the types of the aluminum alloys for die casting Al—Si based alloys having excellent castability and Al—Mg based alloys having good corrosion resistance. A main example of the former is ALDC-3 and a main example of the latter is ALDC-6.

Each of the aluminum alloys has own unique property and a user select a proper type of the aluminum alloys according to the intended use.

As shown in FIG. 1, a power transmission unit provided in a washing machine to transmit the drive force of a motor to a drum should include a shaft and a spider. The spider has a shaft coupling portion provided in a central area to have the shaft coupled thereto; and a drum coupling portion extended from the shaft coupling portion in a radial direction to be connected to a lower surface or a lateral surface of the drum.

The drive force of the shaft may be stably transmitted to the drum via the drum coupling portion of the spider.

The spider is coupled to an outer surface of the drum and the drum is typically mounted in a tub configured to hold wash water therein. Accordingly, the spider is an element configured to contact with water and likely to be corrosive. The spider is also configured to transmit the drive force of the motor and then requires high strength. Also, the washing machines are generally produced in mass and the spiders are also produced in mass, so that the spiders should have good productivity and satisfactory castability.

The currently regulated aluminum alloys 1 to 14 have natural properties, respectively. In other words, each of them has its unique property in aspects of the corrosion resistance, the strength and the castability. For example, a specific type of an aluminum alloy has a good corrosion resistance and a low castability. Accordingly, the required corrosion resistance, castability and strength are likely not to be satisfied by the currently regulated 14 types of the aluminum alloys.

Due to the limits of such the aluminum alloys, a conventional spider is manufactured of aluminum alloy which is ALDC-3. The required castability and strength properties may be gained by using ALDC-3 aluminum alloy. However, in the environments in which the water having relatively high sodium, not just water, is supplied, the corrosion resistance property provided by ALDC-3 is not satisfied disadvantageously. An auxiliary painting process is performed to reinforce the corrosion resistance property of ALDC-3.

In a manufacturing process of the spider, die-casting, surface (short) processing, surface inspection, electro-deposition coating and coating inspection are performed in order. In other words, two processes of surface processing and electro-deposition coating are added between die casting and final inspection and the spider is finally manufactured. It is conventional that such die-casting and electro-deposition coating are not performed by one manufacturer. More specifically, the place where the die-casting is performed is different from the place where the electro-deposition coating is performed. Also, the object which performs the die-casting is different from the object which performs the elector-deposition coating. Accordingly, the manufacturing delay production, increased management costs and increased logistical cost finally result in the increased primary cost of the spider.

To solve such disadvantages, the inventor of the present disclosure put an aluminum alloy having more excellent corrosion resistance than ALDC-3 into consideration. In other words, the electro-deposition coating is omitted by using the excellently corrosion-resistive aluminum alloy so as to decrease the primary cost.

In an aspect of corrosion resistance, ALDC-6 is put into consideration. ALDC-6 has more excellent corrosion resistance than ALDC-3 and gains satisfactory results in a corrosion resistance test. More specifically, a satisfactory corrosion resistance property can be gained even without the electro-deposition coating after the die-casting. ALDC-6 has a higher strength than ALDC-3 by approximately 24% according to the result of the test.

However, it is expected that the castability of ALDC-6 is less excellent than that of ALDC-3. In other words, the castability of ALDC-6 is not so good during the aluminum die-casting process so that ALDC-6 could have a high product error percentage enough to raise the primary production cost. That is caused by the natural property of ALDC-6.

Silicon (Si) which composes the aluminum alloy occupies 0.9~10.0% in ALDC-3 and 1.0% or less in ALDC-6. In this instance, when the weight percentage of a specific element is a specific value or less, the composition ratio is controlled only at impurities but not controlled specifically.

It can be said that Silicon (Si) is the element which make the aluminum alloy less sticky to the mold. In other words, silicon is the element functioned to facilitate the separation of the product from the mold after the die-casting. Accordingly, the silicon content of ALDC-6 is a tenth of the silicon content of ALDC-3 and the deteriorated castability result is quite obvious.

It is academically known that corrosiveness becomes higher as the content of silicon (Si) element increases more. In other words, the difference of the silicon elements content between ALDC-3 and ALDC-6 differentiates the difference of the actual corrosion resistance properties between them, so that such the result of the corrosion resistance difference could coincide with the academic knowledge.

Accordingly, the reality is that the industry accepts it impossible to improve or satisfy corrosion resistance and castability simultaneously. The relation between the corrosion resistance and the castability is contradictory. If one of the corrosion resistance and the castability is improved, the other one is deteriorated. It is obviously known that the aluminum alloy is typically divided into Al—Mg based alloy and Al—Si based alloy.

It is general that the deterioration of a specific physical property should be reinforced in a different aspect. As one example, the corrosion resistance deterioration of ALDC-3 could be covered by other elements such as the coating as mentioned above.

SUMMARY OF THE DISCLOSURE

One object of the present disclosure is to solve the noted disadvantages and problems.

Exemplary embodiments of the present disclosure also provide an aluminum alloy having higher corrosion resistance and castability than the conventional aluminum alloy.

Exemplary embodiments of the present disclosure also provide an aluminum alloy having higher corrosion resistance, castability and strength than the conventional aluminum alloy, especially, an aluminum alloy having the improved castability and strength while keeping the corrosion resistance of ALDC-6.

Exemplary embodiments of the present disclosure also an aluminum alloy cast having a lowered manufacturing cost, especially, an aluminum alloy die-cast having an excellent corrosion resistance and castability. Accordingly, coating is not required to reinforce the corrosion resistance and the increase of the manufacturing cost caused by the coating may be prevented.

Exemplary embodiments of the present disclosure also provide an aluminum alloy cast having higher corrosion resistance, castability and strength, especially, an aluminum alloy cast having the improved castability and strength while keeping the corrosion resistance of ALDC-6.

Exemplary embodiments of the present disclosure also provide an aluminum alloy which is capable of re-using scrap and an aluminum alloy die-casting.

Exemplary embodiments of the present disclosure also provide an aluminum alloy for die casting comprising: a composition ratio having an aluminum (Al) content which occupies almost the composition ratio of the aluminum alloy; a magnesium (Mg) content of 2.5~3.0%; a silicon (Si) content of 9.6~10.5%; a zinc (Zn) content of 0.5% or less; and a copper (Cu) content of 0.15% or less. In this instance, some impurities may be provided.

The aluminum (Al) content may be 74.4~77.2%. In other words, approximately 70% or more of the aluminum alloy composition ratio is aluminum.

The Si content may be 9.9~10.5%.

The Cu content may be 0.1% or less.

The composition ratio of the aluminum alloy further comprises a beryllium (Be) content may be 0.003~0.008%. In other words, a small amount of Be may be provided as the controlled component, not one of the impurities. The beryllium may be very useful in case a scrap is re-used.

More specifically, the Be content is 0.003~0.005% or 0.005~0.008%.

The composition ratio of the aluminum alloy further comprises a titanium (Ti) content of 0.01% and a boron (B) content of 0.002~0.004%.

Exemplary embodiments of the present disclosure also provide a die casting product manufactured by using the aluminum alloy for the die casting.

The temperature of a molten metal for manufacturing the die casting product may be 650° C. which is equal to the temperature of a molten metal for ALDC-3 aluminum alloy. The aluminum alloy for the die casting may have the castability which is equal or higher than the castability of ALDC-3. Accordingly, the conventional mold and method used for ALDC-3 can be used and the primary cost may be lowered remarkably.

A corrosion resistance property of the die casting product may be equal to a corrosion resistance property level of ALDC-6 and a castability property may be more excellent than a castability property of ALDC-3.

A breaking strength of the die casting product may be 3600~4000 kgf/cm$^2$.

The die casting product may be a spider coupled to a rear wall or lower wall of a drum mounted in a washing machine and configured to transmit a drive force of a motor to the drum via a shaft. The spider is the element configured to directly contact with wash water, in other words, to be directly exposed to the very humid and high-temperature environments, so that it should have higher corrosion resistance and strength. Also, the spider may have a higher castability to enhance productivity. In the embodiments, the aluminum alloy is capable of satisfying the required castability, corrosion resistance and strength properties, even without the additional paining or other strength reinforcing structures. At this time, the additional painting for the exterior design is not excluded. It is necessary for the elements directly exposed to a user to satisfy such the castability, corrosion resistance and strength properties.

For example, a door hinge of a drum washing machine may be manufactured by using the aluminum alloy in accordance with the embodiment of the present disclosure. The door hinge is the element exposed to the user so that a transparent painting may be provided to the door hinge to enhance the exterior design or exclude a metallic texture.

Meanwhile, the transparent painting might be damaged by external factors and there might be corrosion in the damaged portion. However, the aluminum alloy in accordance with the embodiments has the high corrosion resistance so as to minimize the corrosion, even with the damage to the painting.

Exemplary embodiments of the present disclosure also provide an aluminum alloy for die casting comprising a composition ratio having an aluminum (Al) content which occupies almost the composition ratio of the aluminum alloy; a magnesium (Mg) content of 2.5~3.0%; a silicon (Si) content of 9.6~10.5%; a zinc (Zn) content of 0.5% or less; and a copper (Cu) content of 0.15% or less; an iron (Fe) content of 0.6~0.7%; a manganese (Mn) content of 0.5~0.6%; a nickel (Ni) content of 0.03% or less; a tin (Sn) content of 0.03% or less; a lead (Pb) content of 0.05% or less; and a boron (B) content of 0.002~0.004%.

Exemplary embodiments of the present disclosure also provide a die casting product manufactured by using the aluminum alloy for the die casting. Examples of the die casting product include a spider and a door hinge.

Exemplary embodiments of the present disclosure also provide an aluminum alloy for die casting comprising a composition ratio having an aluminum (Al) content which occupies almost the composition ratio of the aluminum alloy; a magnesium (Mg) content of 2.6~3.0%; a silicon (Si) content of 9.9~10.5%; a zinc (Zn) content of 0.5% or less; and a copper (Cu) content of 0.15% or less; an iron (Fe) content of 0.6~0.7%; a manganese (Mn) content of 0.5~0.6%; a nickel (Ni) content of 0.03% or less; a tin (Sn) content of 0.03% or less; a lead (Pb) content of 0.05% or less; and a boron (B) content of 0.002~0.004%. Other small-amount elements may be provided.

Exemplary embodiments of the present disclosure also provide a die casting product manufactured by using the aluminum alloy for the die casting. Examples of the die casting product include a spider and a door hinge.

According to the embodiments of the present disclosure, the aluminum alloy may have higher corrosion resistance and castability than the conventional aluminum alloy.

The aluminum alloy may have higher corrosion resistance, castability and strength than the conventional aluminum alloy, especially, the improved castability and strength while keeping the corrosion resistance of ALDC-6.

The aluminum alloy cast may have a lowered manufacturing cost, especially, an excellent corrosion resistance and castability. Accordingly, coating is not required to reinforce the corrosion resistance and the increase of the manufacturing cost caused by the coating may be prevented.

The aluminum alloy cast may have higher corrosion resistance, castability and strength, especially, the aluminum alloy cast may have the improved castability and strength while keeping the corrosion resistance of ALDC-6.

The aluminum alloy is capable of re-using scrap and an aluminum alloy die-casting. Especially, a spider or door hinge of a washing machine made of the aluminum alloy may be provided.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

The present invention will become more fully understood from the detailed description given herein below and the accompanying drawings, which are given by illustration only, and thus are not limitative of the present invention, and wherein:

FIG. 3 is a table showing composition ratios of the conventional ALDC-3 and ALDC-6 and a composition ratio of the aluminum alloy in accordance with the embodiment; and FIG. 4 is a table showing a composition ratio of the aluminum alloy in a test sequence to gain the aluminum alloy in accordance with the embodiment.

DESCRIPTION OF SPECIFIC EMBODIMENTS

Figure 1:
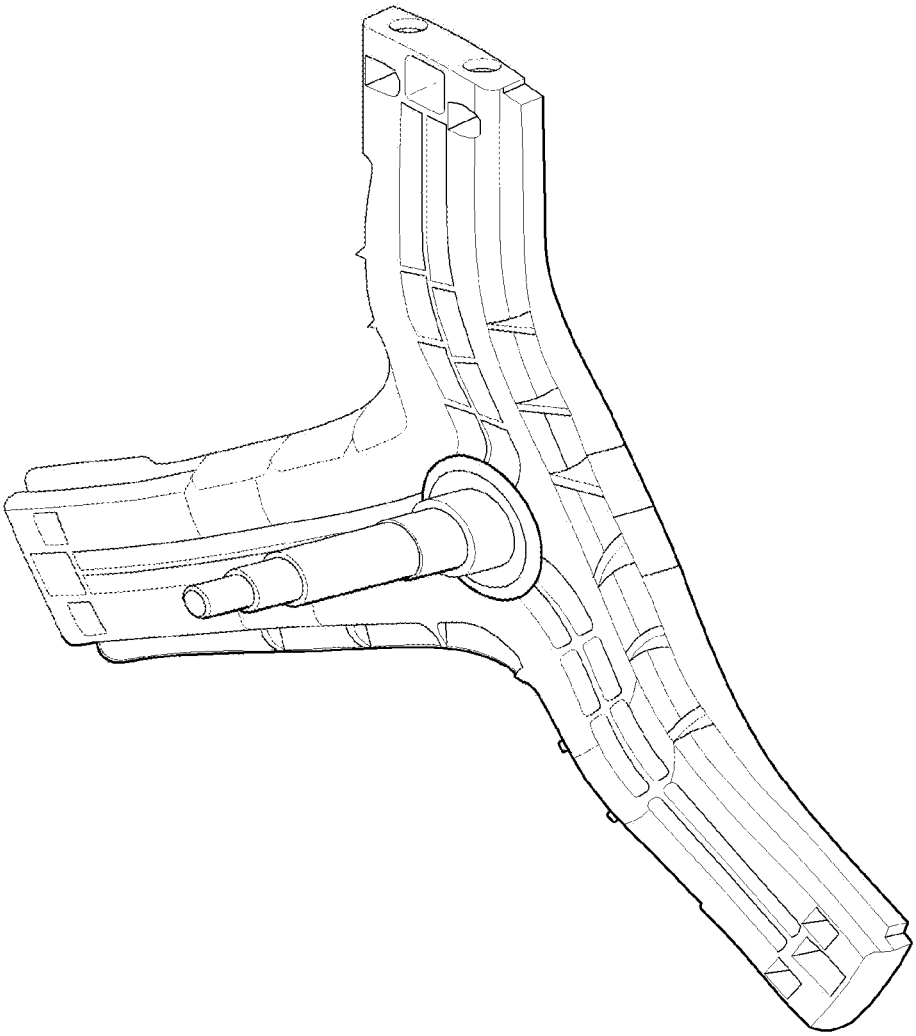
FIG. 1 illustrates a spider which is able to be manufactured of an aluminum alloy in accordance with one embodiment of the present disclosure.

Description of an aluminum alloy for die-casting will now be given in detail according to exemplary embodiments disclosed herein, with reference to the accompanying drawings.

Embodiments of the present disclosure start from a point in question about the fact or theory accepted in tolerate manners. In other words, the present disclosure starts from a question whether the increase of the MS content which is an excellent physical property in the aspect of the corrosion resistance is compatible with the increase of the Si content which is an excellent physical property in an aspect of the castability.

Completely ignoring the theory that the increase of the silicon (Si) will result in the increase of transition corrosiveness while effective in improving the castability, there is an attempt to increase the Si content based on ALDC-6. In this instance, the attempt is resolutely done, ignoring the expectation in theory that the castability is increased while the corrosion resistance is deteriorated.

Hereinafter, an overall process to gain an aluminum alloy in accordance with one embodiment of the present disclosure will be described in detail, referring to FIG. 4. The other except the contents shown in FIG. 4 is almost aluminum and some impurities might be contained.

In a first test which uses ALDC-6, it is described that the satisfactory physical property for the castability failed to be gained. The amount of the aluminum alloy content used in additional 7 tests, in other words, the total 8 tests and the results of the physical properties gained in the tests will be described in detail. The components of ALDC-3 and ALDC-6 are shown in FIG. 3.

On the premise that ALDC-6 satisfies the required corrosion resistance property, a test for increasing the silicon content is performed based on the ALDC-6 content.

In the second test, the silicon content is increased from 0.1% or less to 1.8~2.3%. It is checked based on the result of the test that the required castability property is not gained.

In the third test, the silicon content is increased more to 5.6~6.0%. At this time, it is checked based on the result of the test that the castability is improved but that the required castability property is not gained. Also, the breaking strength is 2900 kgf/cm$^2$ which is not enough to satisfy the required value. According to the result of the third test, when the silicon content is increased, the castability is improved unlike the theory and the increase of the strength is required.

It is necessary to decrease the contents of the other elements according to the increase of the silicon content. In theory, Zinc (Zn) is known as the element capable of effectively increasing the tensile strength and the hardness degree. However, there is an attempt to decrease the Zn content in response to the increased Si content which is the fourth test.

In the fourth test, the similar castability and corrosion resistance properties are gained to the properties gained in the third test. Also, it is checked that the strength is improved about to 3200 in the fourth test. In other words, it is known that the result of the fourth test puts a different complexion on the general knowledge or theory about the Si content and the Zn content. Different from the expectation, the Si content and the Zn content bring the improved result in the castability and the strength.

Accordingly, the fifth test is performed to increase the Si content more and decrease the Zn content more. In the test, the Si content is increased to 9.6~105% and the Zn content is decreased to 0.5% or less.

It is figured out based on the result of the fifth test that the required level is satisfied in the castability, corrosion resistance and strength properties. More specifically, the test result is different from the general knowledge or theory about the Si, Mg and Zn contents.

It may be checked based on the composition ratio of the aluminum alloy gained from the fifth test shown in FIG. 5 that all of the castability, the corrosion resistance and the strength may satisfy the required properties. In other words, a new aluminum alloy having the equal level of castability to ALDC-3 and the equal level of corrosion resistance to ALDC-6 can be invented out of the general knowledge and common sense. In addition, a new aluminum alloy having the equal level of strength to ALDC-3 and ALDC-6 may be invented.

Hence, a test about whether to increase the strength more is performed. The six and seventh tests are performed to test whether the strength is increased by increasing the copper (Cu) content. That is because copper is known in theory as the element capable of increasing the tensile strength and the hardness level.

When the Cu content is increased from a conventional level of 0.1% or less to 0.4~0.6%, it is identified that the strength property is improved as expected. However, the corrosion resistance property is decreased more as figured out from the result of the sixth test.

Accordingly, in the seventh test, the Mg content, which is related with the increase of the corrosion resistance under similar conditions to the sixth test conditions, is increased from a conventional level of 2.0~3.0% to 3.0~3.5%. However, the corrosion resistance is not improved based on the result of the seventh test, different from what is expected.

As a result, it is not easy to increase the strength more noticeably than the result of the fifth test. The eighth test is performed to gain the result that the strength is increased by minimizing the increase of the Cu content, while the corrosion resistance property is not decreased.

More specifically, the Cu content is increased in the eighth test more than in the fifth test and less than in the sixth and seventh tests. In the eighth test, the Mg content is increased to 2.6~3.0%. As expected, the corrosion resistance and castability properties satisfy the required level and the strength property also satisfies the required level. Through the eighth test like the fifth test, a new aluminum alloy is invented and it is known that the results of the two tests are very similar. The corrosion resistance and castability properties of the aluminum alloy invented through the eighth test are almost equal to those of the aluminum alloy invented through the fifth test, while the strength property of the aluminum alloy invented in the eighth test is improved a little.

Through the fifth and eighth tests, the composition ratio of the new aluminum alloy capable of improving all of the corrosion resistance, castability and strength properties may be found out. Such the new aluminum alloy may be referred to as "ALDC6-Si10". As mentioned above, that aluminum alloy is derived from ALDC-6 and the difference between them is the difference of the Si contents.

Through the several tests, the attempts beyond the general common sense in the industry are performed and the result beyond the general knowledge can be gained accordingly.

Meanwhile, a spider of a washing machine is manufactured of the aluminum alloy in accordance with the embodiment of the present disclosure and it has to be considered whether the manufactured spider satisfies the conditions required by the manufactured spider.

First of all, there are following effects in an aspect of the primary cost.

Compared with the spider manufactured by using the conventional ALDC-3 and painting and ALDC-6, the spider manufactured by using ALDC6-Si10 has a lowered manufacturing cost which is approximately 86~94% of the conventional manufacturing cost. When it is premised that such spiders are mass produced, the manufacturing cost can be lowered remarkably. Aluminum occupies almost of the entire content ratio and the other elements occupies a little so that the primary cost may be differentiated by a minute difference of the ALDc-3, ALDC-6 and ALDC6-Si10 contents. Even when the unit cost of a specific element is changed drastically, the overall primary cost is affected little.

Especially, in case of ALDC-6, the temperature of a molten metal is required to be 700° C. and it is not easy to manufacture the molten metal having such a temperature and there is a disadvantage of a high manufacturing cost. However, the temperature of a molten metal required by ALDC6-Si10 is 650° C. which is similar to that of a molten metal required by ALDC-3 so that there may be little change of the conventional manufacturing process in case of ALDC6-Si10. Also, there may be little change of a mold when using ALDC-3 and ALDC6-Si10.

Accordingly, only the material of the mold is changed and the mold and manufacturing process for die-casting are not changed in manufacturing process so that the initial investment cost can be also reduced noticeably.

Not only the primary cost and expense but also the manufacturing process and distribution may be reduced. Therefore, not only the decrease of the primary cost but also moral gains can be expected which are created from the smooth supply and demand of products and factory planning and scheduling.

The result of the corrosion resistance in a high temperature boiling environment of 400 cycles after a salt spray test which is the most severe environment in the washing machine is very satisfactory.

Figure 2:
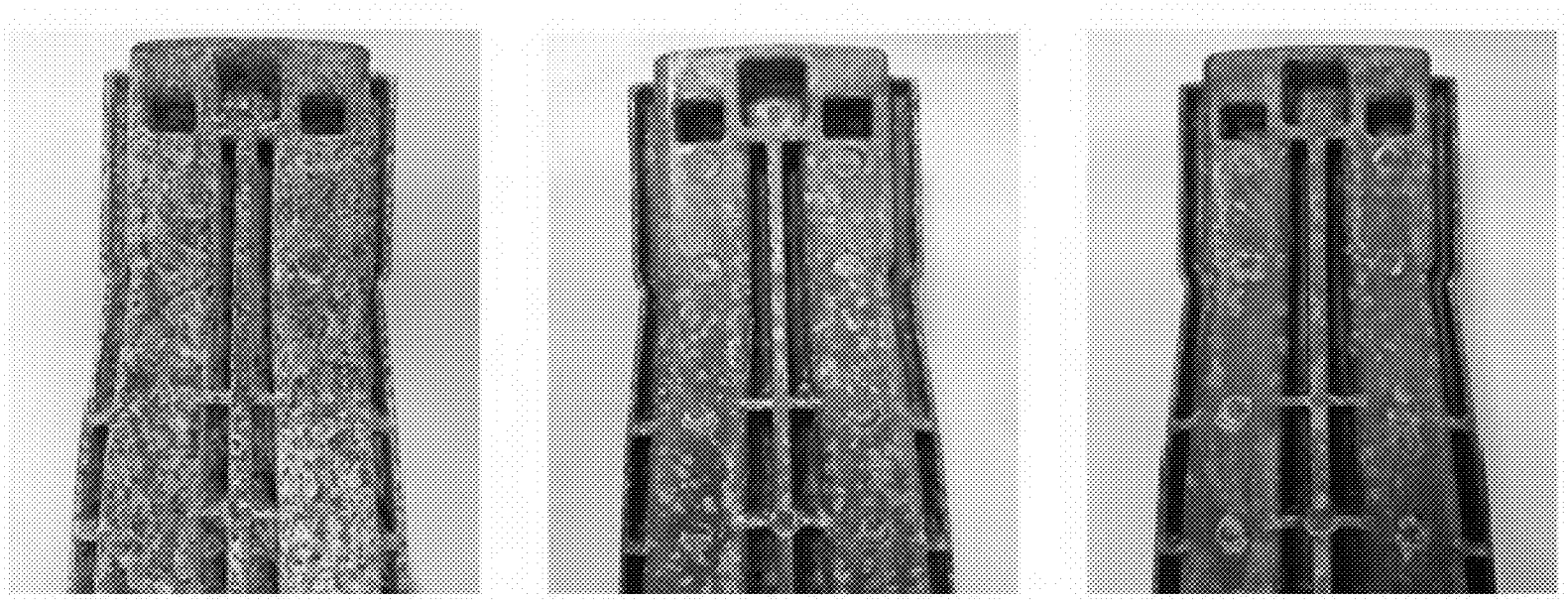
FIG. 2 includes pictures which are showing the results of salt spray tests which are performed to a spider manufactured of the conventional ALDC-3 and ALDC-6 and a spider manufactured of the aluminum alloy in accordance with the embodiment.

FIG. 2 includes pictures which are showing the results of salt spray tests which are performed to a spider manufactured of the conventional ALDC-3 (FIG. 2(*a*)) and ALDC-6 (FIG. 2(*b*)) and a spider manufactured of ALDC6-Si10 (FIG. 2(*c*)). It can be checked that the corrosion resistant effect in ALDC6-Si10 is remarkably good such as a corrosion generation position and a corrosion generation size.

All of the properties required by a test list of the spider about a structure exterior, measurements, the salt spray test, a humidity resistance test, a detergent resistance test, a fabric softener test, a bleacher (oxygen-based) resistance test, a bleacher (chloride-based) resistance test and cooling/heating resistance may be satisfied.

Moreover, all of the properties required by a test list of the spider for an assembly attached to a drum and a test list of the entire washing machine may be satisfied.

Meanwhile, for the aluminum die casting, an ingot is generally melted and used. However, a scrap which will be left after the aluminum die casting is re-used. More specifically, after melted and hardened, the ingot is re-melted and re-used. It is melted again and used in case the manufactured mold has an error or it is recycled. Especially, when re-using such the scrap, Mg might be oxidized only to deteriorate the physical properties of the aluminum.

Accordingly, it is preferred that the return scrap is used by preventing the oxidization of Mg so as to lower the manufacturing cost and protect the environments.

In the fifth and eighth tests shown in FIG. 1, the Beryllium (Be) content is 0.005~0.008% to facilitate the re-use of the return scrap.

According to the embodiments mentioned above, the aluminum alloy may have a chemical consisting of a balance of Aluminum (Al), a plurality of elements and unavoidable impurities. The contents of Aluminum and other elements are controlled except the unavoidable impurities. Also, an amount of each component is given in "wt-%" based on the total weight of the aluminum alloy.

According to the embodiments mentioned above, the basket with the beautiful design and the sub storage compartment including the same may be realized. Also, the user is able to manipulate the moving basket smoothly. Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An aluminum alloy for die casting comprising:

aluminum (Al), magnesium (Mg), silicon (Si), zinc (Zn), copper (Cu), beryllium (Be), iron (Fe), manganese (Mn), nickel (Ni), tin (Sn), lead (Pb), titanium (Ti), boron (B), and calcium (Ca), wherein the aluminum alloy comprises by weight:

2.6 to 3.0% magnesium (Mg);

9.9 to 10.5% silicon (Si);

0.5% or less zinc (Zn);

0.15% or less copper (Cu);

0.5 to 0.6% manganese (Mn);

0.03% or less nickel (Ni);

0.03% or less tin (Sn);

0.05% or less lead (Pb);

0.01 to 0.02% titanium (Ti);

0.002 to 0.004% boron (B);

0.01% or less calcium (Ca);

iron (Fe) greater than 0.65% and less than or equal to 0.7%;

0.005% to 0.008% beryllium (Be); and a balance including aluminum (Al) and unavoidable impurities.

2. The aluminum alloy of claim 1, wherein Fe is about 0.7% of the aluminum alloy by weight.

3. A die casting product manufactured by using the aluminum alloy of claim 1.

4. The die casting product of claim 3, wherein a temperature of a molten metal for manufacturing the die casting product corresponds to a temperature of a molten metal of an ALDC-3 alloy.

5. The die casting product of claim 4, wherein the temperature of the molten metal of the ALDC-3 alloy is 650° C.

6. The die casting product of claim 3, wherein the die casting product has a corrosion resistance property that corresponds to a corrosion resistance property of an ALDC-6 alloy, and a castability property that is greater than a castability property of an ALDC-3 alloy.

7. The die casting product of claim 3, wherein the die casting product has a breaking strength in a range from 3600 to 4000 kgf/cm$^2$.

8. The die casting product of claim 3, wherein the die casting product includes a spider that is configured to couple to a rear wall or lower wall of a drum, the drum being configured to be mounted in a washing machine, and wherein the spider is configured to transmit drive force of a motor to the drum.

* * * * *